United States Patent [19]

White

[11] Patent Number: 4,623,069

[45] Date of Patent: Nov. 18, 1986

[54] NIPPLE AND NURSING CONTAINER

[75] Inventor: Leonard A. White, Gurnee, Ill.

[73] Assignee: Baxter Travenol Laboratories, Inc., Deerfield, Ill.

[21] Appl. No.: 599,301

[22] Filed: Apr. 12, 1984

[51] Int. Cl.[4] ..... A61J 9/00; A61J 9/08; A61J 11/04

[52] U.S. Cl. ..... 215/11 R; 215/11 C; 215/11 E

[58] Field of Search ..... 215/11 R, 11 C, 11 E, 215/11 B, 11 D; 128/360

[56] References Cited

U.S. PATENT DOCUMENTS

| | | | |
|---|---|---|---|
| 131,130 | 9/1872 | Stevenson | 215/11 R |
| 582,159 | 5/1897 | Heller | 215/11 R |
| 686,109 | 11/1901 | Mulhens | 215/11 R |
| 1,081,464 | 12/1913 | Pfeiffer | 215/11 R |
| 1,270,693 | 6/1918 | Caldwell | 215/11 R |
| 1,588,846 | 6/1926 | McGeary | 215/11 R |
| 1,656,157 | 1/1928 | Correnti | 215/11 R |
| 2,133,411 | 10/1938 | Zohe | 215/11 R |
| 2,366,214 | 1/1945 | Ramaker | 215/11 R |
| 2,541,934 | 2/1951 | Piazze | 215/11 E |
| 2,542,021 | 9/1950 | Rigby et al. | 215/11 E |
| 2,588,069 | 3/1952 | Allen | 215/11 R |
| 2,604,222 | 7/1952 | Teague et al. | 215/11 E |
| 2,885,104 | 5/1959 | Greenspan | 206/222 |
| 2,954,030 | 9/1960 | Jozwiak | 215/11 R |
| 3,117,874 | 1/1964 | Horan | 215/11 R X |

FOREIGN PATENT DOCUMENTS

| | | | |
|---|---|---|---|
| 2302724 | 10/1976 | France | 215/11 R |

*Primary Examiner*—William Price
*Assistant Examiner*—Sue A. Weaver
*Attorney, Agent, or Firm*—Paul C. Flattery; John P. Kirby, Jr.; Bradford R. L. Price

[57] ABSTRACT

An artifical nipple is disclosed which is interactive with an infant to provide a stimulus/response operation. The nipple portion has a generally cylindrically shaped, but undulated deformable outer wall closed at one end and a resilient elongated member disposed interior of the outer wall, depending from the closed end. The elongated member is spaced from the interior of the outer wall to define an annular chamber such that an infant will meet two levels of resistance to lateral compression of the nipple and a plurality of dispensing apertures provided communicating with said annular chamber, so that fluid flows through certain of said apertures in a manner responsive to infant suckling action.

A nursing container utilizes the artificial nipple and a flexible fluid container is sealed to the nipple portion along a tapered shoulder. The nursing container may be made by injecting molten elastomeric material into a mold cavity defining a nipple including a radially extending base portion with a tapered annular shoulder. A plastic sheet with an aperture is situated with peripheral edge of the aperture adjacent the portion of the mold defining the tapered shoulder. The nipple is simultaneously molded and sealed to the plastic sheet, and the sheet is subsequently formed into a fluid container.

23 Claims, 16 Drawing Figures

FIG. 1
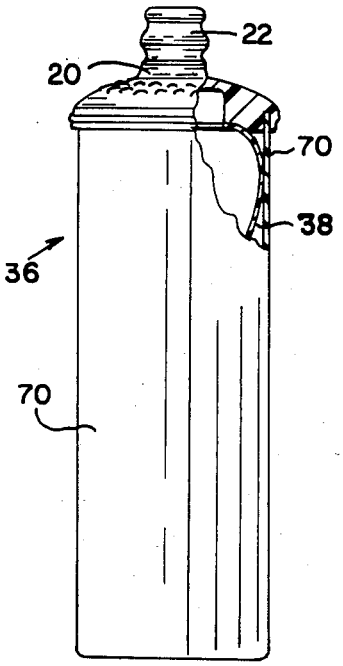
FIG. 2
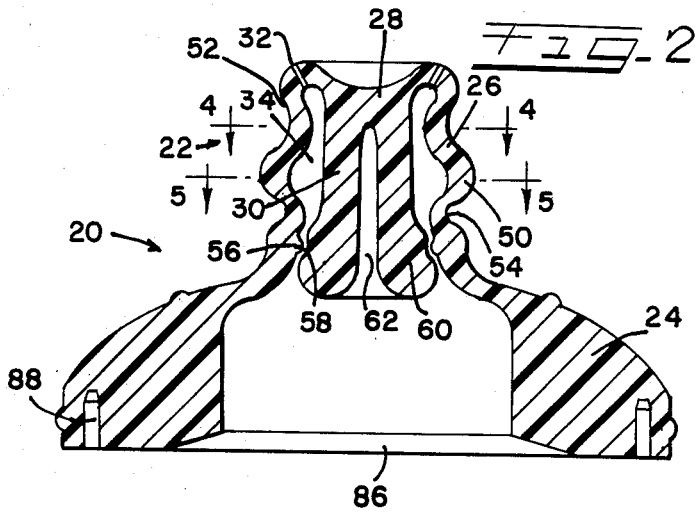
FIG. 3
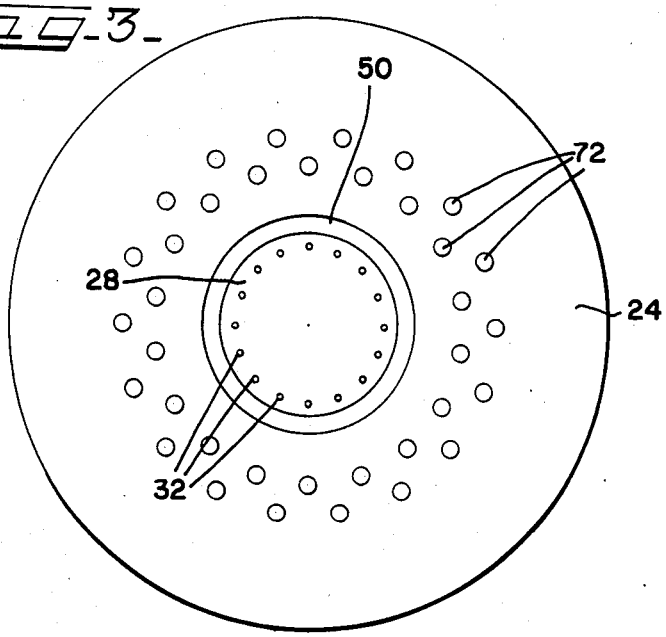
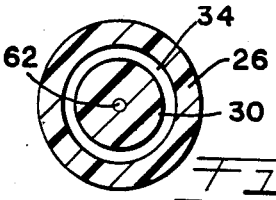
FIG. 4
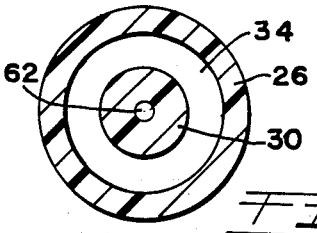
FIG. 5
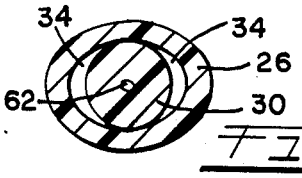
FIG. 7
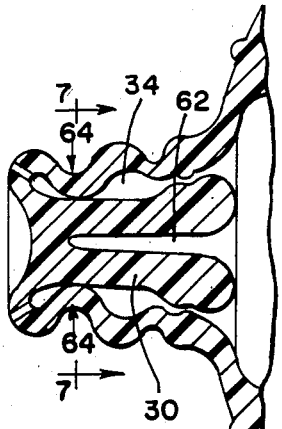
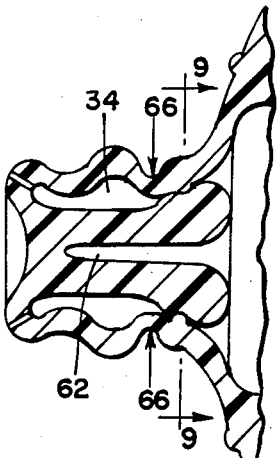
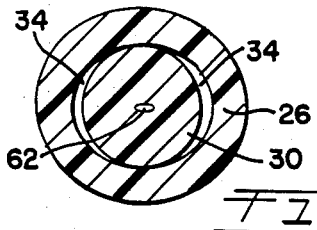
FIG. 9 FIG. 6 FIG. 8

FIG. 10
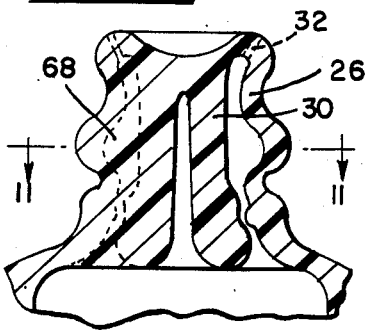
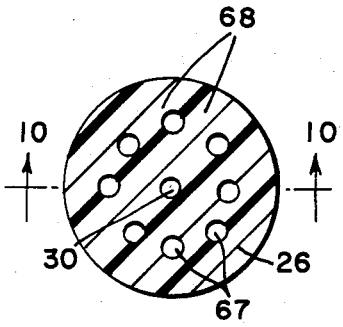
FIG. 11
FIG. 12
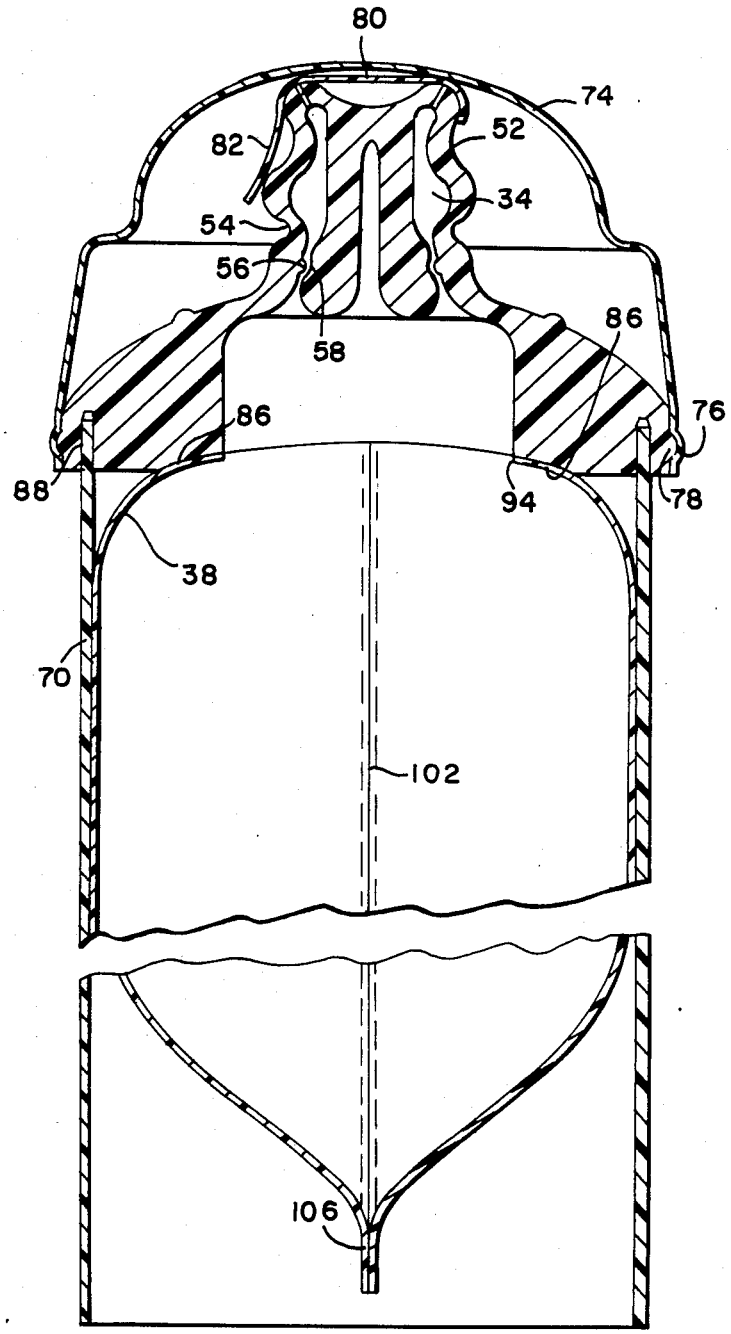

FIG. 16
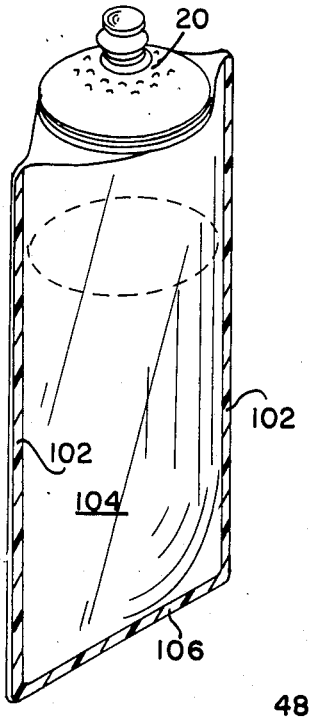
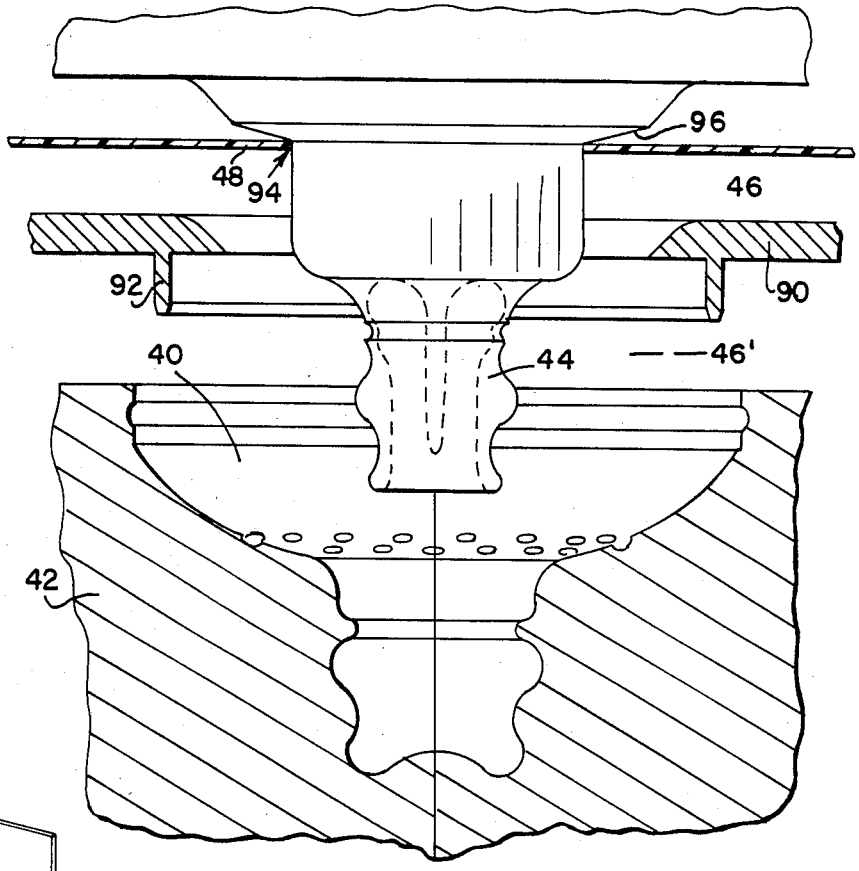
FIG. 13
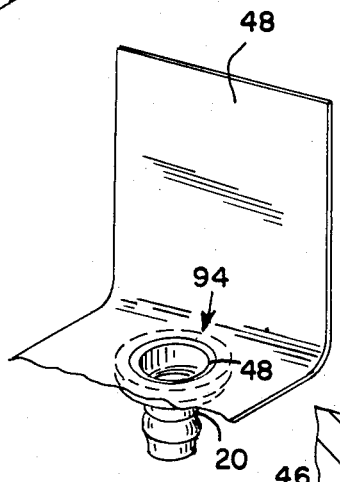
FIG. 15
FIG. 14
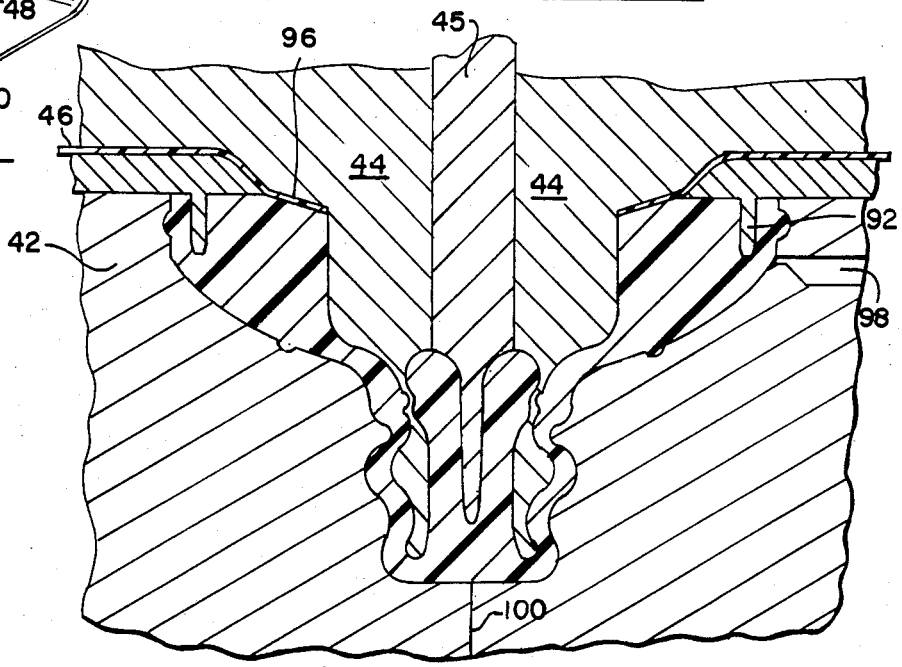

NIPPLE AND NURSING CONTAINER

The present invention relates to artificial nipples for use with infant nursers pacifiers, and the like. More specifically, the invention relates to an improved nipple construction alone, to the improved nipple construction in combination with a nursing container,and to a method for making a nursing container having an in-situ molded nipple.

It is conventional in the construction of artificial nipples for infant feeding and the like to have a nipple portion to be grasped by a suckling infant and a mounting portion which may be configured to be held by the infant or an adult, as in the case of a pacifier, or for attachment to a fluid container, as in the case of a nurser. Although nipples in the past have had a wide variety of shapes, as shown for example in U.S. Pat. Nos. 1,985 to Windship, 2,524,021 to Rigby et al., 2,541,934 to Piazze, 2,604,222 to Teague et al., and 2,987,208 to Ransom, the prior art indicates a general lack of nipple constructions which are interactive with the infant. For example, the nipple portion of typical prior nipples was formed simply by a hollow outer wall of flexible material formed in the desired shape. Lateral compression of the nipple would completely collapse the nipple, closing all flow of liquid to the infant and offering very little resistance to the sucking action of the infant. As the infant grows and gains oral strength the resistance becomes almost negligible. Further, in contrast to human anatomy, prior nipples contained only one or at most a few apertures located at the tip, resulting in dispensing of fluid from substantially the same area in the nipple no matter where oral pressure was applied on the nipple.

While the Windship patent shows an attempt to copy some aspects of the human breast, it and later references focus on superficial aspects of the nipple and do not teach an internal nipple structure to produce a life-like resistance to sucking compression. Neither do these references teach a nipple with multiple dispensing apertures to encourage stimulus and response interplay with the nipple such that pressure applied by part of the infant's mouth would result in a correlating dispensing of fluid at another location.

Accordingly, a general object of the present invention is to provide an improved nipple construction which is highly infant interactive and does not suffer from the drawbacks described above.

It is a further object of the present invention to provide an improved nipple construction which is not limited to a particular application, such as a pacifier, nurser or the like.

It is a further object of the present invention to provide an improved nipple construction which is particularly suited for attachment to an infant nurser Another object of the present invention is to provide a nipple construction having a multiplicity of levels of resistance to lateral compression by a teething or nursing infant.

A further object of the invention is to provide a nipple construction which provides a different lateral resistance to older infants than to younger infants.

Yet another object of the invention is to provide an artificial nipple which creates a different flow depending upon the location of pressure applied to the nipple.

It is still another object of the present invention to provide a method of making a nursing container having an in-situ molded nipple of the improved or other construction.

In brief, the present invention contemplates an artificial nipple of the type having an elongated flexible nipple portion and a mounting portion. In accordance with the present invention, the nipple portion includes a generally cylindrically-shaped hollow deformable outer wall and and elongated deformable inner member spaced from the interior surface of the outer wall to provide two levels of resistance to lateral compression of the nipple by an infant. The nipple surface has a plurality of infant gripping areas and has different compression characteristics at different locations for effecting selected reactions to different biting or suckling actions of the infant. It should be appreciated that the nipple of the present construction may be used in a wide variety of applications and, while being particularly well suited for use with an infant nurser, it is not limited to that application or to other applications such as in a pacifier or as a teething member. For use as an infant nurser, a plurality of dispensing apertures may be provided communicating with the annular space between the outer wall and interior member to permit dispensing of liquid from a container to which the nipple is attached. The plurality of apertures, in combination with the annular space, which may be subdivided into angularly discrete passageways, produces a liquid flow which varies with infant biting or suckling action, just as does the human breast, thereby providing a direct and immediate interactive response to infant suckling.

As noted above, the improved nipple construction may be employed in a variety of applications, but is particularly useful in combination with a nurser. While it may be used with different types of nursers without departing from the present invention, the preferred nurser comprises a liquid container having an inner flexible liner or bladder sealed to the nipple, and an outer rigid shell supporting and enclosing the liner. The inner liner collapses as liquid is dispensed, thus not requiring displacement air entry into the container. The rigid shell encloses, supports and protects the liner.

The present invention also contemplates a method of making a nursing container with an in-situ molded nipple of the preferred or other construction, including the steps of providing a mold cavity; locating a sheet of plastic material with the peripheral edge of an aperture in the mold cavity; closing the mold cavity; injecting molten elastomeric material under pressure into the mold cavity to simultaneously mold the nipple and seal it to the sheet; removing the sheet and bonded artificial nipple from the mold; and forming the sheet into a fluid container. More specifically, the mold cavity has the shape of an artificial nipple including a cylindrically-shaped portion with a closed end and a radially extending base portion. The peripheral edge portion of the plastic sheet is located in the mold cavity adjacent to that part of the mold defining the nipple base portion. After the mold cavity is closed, elastomeric material is injected to simultaneously mold the nipple and seal it to the peripheral edge portion of the plastic sheet at the base portion.

The preferred and alternative embodiments of the contemplated invention are set forth for the purposes of illustration and not limitation in the following written description referring to FIGS. 1–16.

FIG. 1 is an elevational plan view of the preferred embodiment of the nipple of the present invention employed in a nursing container, with a section cut-away to expose the interior of the nipple mounting arrangement.

FIG. 2 is a vertical sectional view of the nipple employed in the nursing container of FIG. 1 and embodying the present invention.

FIG. 3 is a top plan view of the nipple of FIG. 2.

FIG. 4 is a cross-sectional view of the nipple of FIG. 2, taken along line 4—4 of FIG. 2.

FIG. 5 is a cross-sectional view of the nipple of FIG. 2 taken along line 5—5.

FIG. 6 is a fragmented sectional view of the nipple of FIG. 2, depicting lateral compression of the nipple portion as may occur with a young infant.

FIG. 7 is a cross-sectional view of the nipple of FIG. 6 taken along line 7—7.

FIG. 8 is a fragmented cross-sectional view of the nipple of FIG. 2 depicting lateral compression of the nipple portion as may occur with an older infant.

FIG. 9 is a cross-sectional view of the nipple of FIG. 8 taken along line 9—9.

FIG. 10 is a vertical sectional view of an alternative embodiment of the artificial nipple.

FIG. 11 is a horizontal cross-sectional view through section 11—11 of the alternative embodiment of the artificial nipple shown in FIG. 10.

FIG. 12 is a vertical sectional view of one version of the nursing container embodying the present invention, including cap and nipple seal.

FIG. 13 is a partial sectional view of molds in an open position employed in the process for making a nipple and container of the present invention.

FIG. 14 is a vertical sectional view of the mold sections of FIG. 13 shown in the closed position and after the mold cavity has been injection filled.

FIG. 15 is a perspective view of the molded nipple with attached plastic sheet after removal from the mold and depicting the saddle or configuration of the sheet arising from the shape of the underside of the nipple.

FIG. 16 is a perspective view of the nursing container after forming of the container bag from the plastic sheet, and sealing.

In summary, the present invention is generally embodied in a unique nipple 20 which is particularly useful for infant feeding, although it may also be used as a pacifier, teething nipple or in other non-nurser applications. The nipple 20 is of one-piece construction and includes a tip portion 22 which is intended to be orally grasped by the infant and a base portion 24 mounting the nipple to a nursing container or the like. In accordance with preferred aspects of the present invention, the tip portion of the nipple has a generally cylindrical but undulated outer wall 26 which is closed at one end 28 and an internal elongated member 30 which depends from the closed end and is spaced from the outer wall to provide two levels of bite resistance to an infant.

For dispensing liquid to an infant in a manner which provides a stimulus-response interaction with the infant, a plurality of dispensing apertures 32 are provided at spaced locations around the tip of the nipple in communication with annular chamber 34 located between the outer wall 26 and internal member 30. As the nipple is gripped by the infant at different positions, different portions of the annular chamber 34 are opened and closed, and liquid is directed to flow through different apertures, thus encouraging stereonostic familiarization in the infant. As set forth more fully hereinafter, the undulated shape and selective thickness of the outer wall 26 also cooperates with the internal member 30 to provide selected nipple response in selected areas of the nipple to interact with infants of different age and oral strength.

Although the nipple 20 of the present invention may be used as a pacifier or teether, as noted earlier it is particularly useful when employed in combination with a nursing container generally at 36 for feeding infants. For such application, the nipple 20 is preferably attached to a flexible pouch 38 (FIGS. 1 and 12) which collapses upon dispensing of the contents and does not require displacement air. In the container 36 of the present invention, the nipple 20 is bonded directly to the flexible pouch walls, providing a hermetically sealed unit until the contents are dispensed. To support and enclose the flexible pouch 38, the container 36 also includes an outer sleeve 70 fixedly secured to the base portion 24 of the nipple.

In accordance with yet further aspects of the present invetnion, the nipple 20 is simultaneously molded and bonded to the flexible container wall in a mold cavity 40 such as that depicted in FIGS. 13 and 14. The molding cavity 40 is generally defined between a female mold 42 which defines the outer surface of the nipple 20 and a male mold 44 which defines the interior surface. A plastic sheet 46, which is eventually formed into the pouch 38 is positioned between the molds, and the male mold inserted through a pre-punched aperture in the sheet. The molds are designed to expose a portion of the sheet at the peripheral edge 48 of the aperture to molten plastic which is injected into the mold to form the nipple so that the nipple is simultaneously bonded to the sheet as it is molded.

Turning now to a more specific description of the attached drawings, and specifically to the nipple 20 depicted in FIGS. 1-9, the nipple is preferably of one-piece construction, molded of a suitable resilient plastic or rubber material such as thermoplastic rubber, Kraton G elastomer of the Shell Chemical Co., or blends which are preferably compatible with the pouch material for bonding to the pouch wall. The nipple tip portion 22 is of primary concern with respect to interaction with the infant. As noted earlier, the particular shape and thickness of the outer side wall 26 as well as the plurality of dispensing apertures 32 and the internal member 30 cooperate to provide a stimulus-response nursing system for infants of various ages.

To provide different gripping areas spaced axially along the nipple portion, the side wall 26 is undulated in cross-sectional shape to form a radially extending annular undulation 50 located between two annular troughs 52 and 54. It is expected that the infant will hold the nipple 20 in its mouth at one of the annular troughs—the smaller neonate grasping at the first annular trough 52 nearer the closed end of the nipple, and the older, larger infant grasping at the second annular trough 54 nearer the base portion 24. Because different aged infants are likely to be able to exert different oral gripping forces, the wall 26 is also preferably thicker adjacent to the base portion than at the distal end of the tip, so as to provide increased resistance to biting or compression by the older infant.

The infant interaction qualities of the present nipple is enhanced by the particular shape and resilience of the internal member 30. As evident from FIG. 2, the internal member freely depends from the closed end wall 28 of the nipple. The width of the internal member, and thus the width of the annular chamber 34 varies along the length of the elongated member 30. The narrowest portion of annular chamber 34 is defined between an annular internal rib 56 which projects inwardly from the wall 26 and a matching annular groove 58 on the enlarged end portion 60 of the internal member. The annular chamber 34 is widest interior of the radially extending annular undulation 50. Compression by an infant at either the first or second troughs will partially restrict flow of fluid through the annular chamber 34 and out the dispensing apertures 32. To provide resilience against biting, the internal member 30 is also preferably hollow as depicted at 62.

The plurality of dispensing apertures 32 communicate between the annular chamber 34 and the exterior of the nipple 20 to allow fluid to pass out of the flexibe container or pouch 38. The dispensing apertures 32 are preferably arranged in a circle about the periphery of the closed end 28. Preferably there are between about 6 and 36 (although 16 is most preferred) equally spaced in a ring or circle around the closed end 28, although the invention contemplates that as few as two apertures 32 may be used in any pattern or geometrical shape in order to partake of advantages of the present invention.

The interaction function of the nipple 20 when used with a nurser is depicted more specifically in FIGS. 4–9, keeping in mind the fluid flow path through the nipple is generally through the base portion 24, into annular chamber 34 and through the dispensing apertures 32.

The side wall 26 of the tip portion 22 is configured so that the smaller or younger neonate will most likely suck on the tip of the nipple laterally compressing the tip as shown by arrows 64 in FIG. 6. A larger infant will more likely grasp a greater proportion of the nipple and laterally compress arrows 66 in FIG. 8. It should be noted that the younger neonate is thus gripping at a location where the annular chamber 34 is wider than for the older or more aggressive infant, thus providing less resistance to compression.

Without lateral compression of the tip, the fluid flows evenly aroundtheinterior member 30, as shown by the circular shape of annular chamber 34 in FIGS. 4 and 5, through the dispensing apertures and to the infant. When oriented in this position the fluid will flow evenly through all of the dispensing apertures 32. When the smaller neonate compresses at arrows 64, the annular trough 52 is deformed as shown in FIG. 7, into an oval shape, pressing top and bottom sides flush against internal member 30. During this deformation, the annular chamber 34 is divided into two crescent-shape passages through which fluid may still flow. Similarly, the larger infant compressing at arrows 66 will deform outer side wall 26 such that annular rib 56 is flush on two sides with groove 58 in the distal end of the internal member, thus shaping the annular chamber 34 into two crescents as seen in FIG. 9. In either situation, fluid flow is restricted to the two crescent shaped parts of annular chamber 34 and fluid flow to the infant will be primarily from the apertures 32 most directly associated with those crescent shaped passageways.

The infant when sucking on the nipple typically flexes the nipple alternatively compressing and releasing it. Consequently, it is expected that flow will alternate between being through all of the dispensing apertures 32 and being primarily through the dispensing apertures corresponding to the two crescent-shaped parts of the annular chamber 34. Several advantages result from this configuration. The smaller neonate will grasp the nipple near the closed end 28 at about arrows 64 and will partially restrict flow of fluid with minimal flexing effort. An older infant will apply stronger flexing on the lower part of nipple near the second annular trough 54 and also partially restrict free flow of the fluid through some of the dispensing apertures. In both neonates and older infants, the partial restriction of fluid flow during flexing helps to develop tactile sensation and neuro-motor ability of the infant. Further, variations in flexing compression on the nipple will create different flow rates through different dispensing apertures 32, thereby encouraging stereonostic familiarization of the bucal mucous membrane in the infant. This cause and effect relationship of different action on the nipple producing a different stimulus to the infant's mouth is important to development of oral coordination. Such variations in fluid dispensing are not possible in a nipple having only a single dispensing aperture.

FIGS. 10 and 11 depict an alternative embodiment of the tip portion 22 of the nipple 20 having a plurality of angularly distinct axial passageways 67 each of which has at least one dispensing aperture 32 so that flow through the discrete subchamber is not impeded. The radial walls 68 which separate the axial passageways help support the outer wall 26, maintain the symmetry of the annular chamber 34, and direct flow through the dispensing apertures 32. There are preferably about 10 but no fewer than two axial passageways 67. Compression of a particular passageway by an infant will completly restrict flow through the apertures associated with said subchamber, thereby making the nipple reaction to infant compression biting more distinct and predictable.

As illustrated in FIG. 12, the base portion 24 of the nipple is particularly suited for attachment to a nursing container for dispensing liquid to an infant. As described earlier, the nipple of the present invention is also useful for many other purposes, and the depiction of the nipple for use with a nurser should not be construed as a limitation of the nipple construction to that application. In other applications, for example as a pacifier, the slope of the base could be drastically changed without departing from the present invention.

In the illustrated embodiment, the base portion 24 is of enlarged, generally radial shape particularly suited for mounting the nipple to the flexible pouch 38 and the rigid protective sleeve 70. Additionally, the base portion has features for encouraging infant stimulation.

The outer surface of the base portion 24 contains tubercles 72 preferrably arranged in two concentric circles around the tip portion 22 to stimulate the tactile senses of the cheeks of the suckling infant. Preferably there are about 36 tubercles, 18 arranged in each of the two circles, with the outer ring of tubercles displaced so each turbercle is situated midway between the adjacent inner ring tubercles. Alternatively, any number of tubercles 72 can be arranged in any geometry on any portion of the base to provide tactile stimulation of the infant.

The undersurface of the nipple base portion 24 preferably has a pair of opposed angled shoulder surfaces 86 to which the walls of puch 38 are bonded in a generally horseshoe or saddle-shaped arrangement. This is prehaps best understood by comparing the cross-sectional view in FIG. 12 with that in FIG. 2, which is rotated 90° with respect to FIG. 12. The result is that the pouch walls joint the nipple in a gentle curved engagement which naturally bends opposed panels of the container toward each other as diagrammatically shown in FIG. 5, for later joining. Otherwise, if bonded to a flat bottom surface of the nipple, the container wall would abruptly bend along the bond line, creating undesirable stress in the container wall, as well as making insertion into an outer sleeve or container 70 more difficult.

A complete nursing container 36 is depicted in cross-section in FIG. 12. It includes a snap-on rigid, preferably plastic, cover 74, which has an annular groove 76 to engage the annular rib 78 formed on the outer surface of the base portion 24 of the nipple 20. The cover 74 maintains the nipple 20 in a clean condition. If sterility is desired, a shrink band or similar sealing band may be provided around the cover to seal the nipple from the exterior. The dispensing apertures 32 are preferably also hermetically sealed by a removable sealing tab 80 which covers the apertures and has an unattached portion 82 which may be grasped to remove the tab. One particular type of pull-tab which may be suitable is made of metallized polyester with a pressure sensitive acrylic adhesive, such as that marketed by 3M under the trade name "Scotchtab".

The pouch 38 of the nurser shown in FIG. 12 is preferably made of flexible pastic material such as polyethylene, polypropylene or various blends compatible with the nipple material for thermal bonding. The flexibility permits dispensing of the contents without displacement air. While illustrated as a single layer, the pouch 38 may be of multiple layer construction and, in either case, preferably includes an oxygen barrier, such as Saran plastic from The Dow Chemical Co., to provide long shelf life.

The pouch is preferably completely sealed to the exterior, except for and end aperture 84 communicating with the interior of the nipple 20. The nipple is preferably thermally bonded to the peripheral edge 48 of the aperture above a generally tapered annular shoulder 86 which helps direct liquid into the nipple during dispensing.

The rigid cylindrical sleeve 70 surrounds the flexible container or pouch 38 protecting it from damage and supporting it. The sleeve 70 is preferably made of plastic or polymer-coated spiral wound paperboard but alternatively may be made of any sturdy material known in the art. For mounting the nipple 20, the sleeve is inserted within a groove 88 by the friction fit, epoxy, solvent, heat bonding or any standard method known in the art. The opposite end of the sleeve is preferably open so the contents of pouch 38 may be directly heated, as by hot water bath. Additionally, the sleeve 70 may be opaque, or viewing apertures (not shown) may be located in sleeve 70 to provide for viewing the level of contents in pouch 38.

When the nursing container is desired to be used, the cover 74 is removed from the nipple 20 and pull tab 82 removed from the closed end 28 thereby exposing the dispensing apertures 32. The nursing container is inverted to cause fluid in the pouch 38 to flow through the base portion 24, through the annular chamber 34 and out the dispensing apertures 32 and into the nursing infant. The sucking action of the infant affects the fluid flow as described above.

In accordance with other aspects of this invention, a flexible nursing container may be constructed by simultaneously molding the nipple, of the preferred or alternative construction, and bonding it to the container wall. One type of mold which may be employed in connection with such a simultaneous molding and attachment process is depicted in FIGS. 13 and 14. The mold cavity 40 there is defined by sections: The female mold 42, the first male mold or insert 44, the second male mold or insert 45, and an intermediate mold member 90. The female mold defines the exterior surfaces of the nipple 20. The male or insert members define the interior configuration of the nipple 20, and intermediate mold 90 has an annular projection 92 to define the sleeve receiving groove in the base portion of the nipple.

The plastic sheet 46, which is eventually formed into pouch 38 is positioned between the male mold 44 and the intermediate mold 90, with the male member extending through aperture 94 in the sheet. The mold cavity 40 is formed when the mold sections 42, 44 and 90 are brought together. Simultaneously, the plastic sheet 46 is brought down into the mold cavity with peripheral edge portion 48 held tightly against a tapered annular shoulder portion 96 of the male mold member 44.

After the mold is closed, molten elastomeric material is injected into the mold cavity 40 under pressure through sprue 98, simultaneously molding the nipple and sealing the base portion of the nipple 20 to the peripheral edge portion 48 of the plastic sheet 46. After cooling, the plastic sheet 46 and bonded nipple 20 are removed from the mold cavity by separating the female mold at the parting line 100, pulling the second male mold member 45 and then the first male mold 44 out of the nipple 20, and detaching the nipple 20 and plastic sheet 46 from intermediate mold plate 90. Dispensing apertures 32 are subsequently provided, preferably by laser piercing of the closed end 28 of the nipple 20, or alternatively, by mechanically punching or piercing the end 28.

As best seen in FIG. 15, the plastic sheet 46 is saddle-shaped where joined to the nipple and otherwise substantially flat when removed from the mold, with peripheral edge 48 sealed to the nipple 20 at shoulder 86. To form a container, the ends of the sheet are brought fully into a generally facing relationship. The side edges 102 are then sealed, and, after the pull tab is attached to the nipple, the pouch is inverted and filled with liquid 104. The bottom edge 106 is sealed to produce a completely sealed container pouch 38, shown in FIG. 16. The support sleeve 70 is subsequently attached to nipple 20, as previously described, to enclose and support the pouch 38.

Alternatively, of course, the nipple portion may be independently injection molded or blow molded and sealed to a pre-formed bag or unformed plastic sheet by conventional methods.

Those who are skilled in the art will appreciate that various modifications can be made to the embodiments described herein without departing from the scope of the present invention. Accordingly, it is intended that the foregoing description be taken in an illustrative sense, and that the scope of protection be defined by the appended claims.

What is claimed is:

1. A nursing container comprising:

a nipple having a resiliently deformable wall defining a generally cylindrically shaped hollow outer surface, closed at one end, mounting means carrying said wall opposite said closed end, a resilient elongated member interior of said deformable wall and depending from said closed end, said elongated member being spaced from the interior surface of the wall to define an annular space between the wall and the elongated interior member, and a plurality of dispensing apertures communicating between the annular space and the exterior, the elongated member and deformable walls cooperating to provide means for restricting the flow of fluid through select dispensing apertures;

a flexible fluid container bag having an open end and a closed end, the open end being sealed to the mounting means; and whereby fluids can flow through the annular space and the dispensing apertures to the exterior.

2. The nursing container of claim 1 wherein the elongated member is substantially hollow.

3. The nursing container of claim 1 wherein the wall comprises at least one radially extending annular undulation.

4. The nursing container of claim 3 wherein the annular space is widest interior of said annular undulation.

5. The nursing container of claim 3 wherein the wall further comprises an annular trough between the sealed end and the annular undulation.

6. The nursing container of claim 1 wherein said mounting means comprises a radially extending base portion having a plurality of protruding tubercles on the exterior thereof.

7. The nursing container of claim 1 further comprising means segmenting said annular space between said wall and said elongated member into a plurality of angularly discrete spaces.

8. The nursing container of claim 7 further defining at least one dispensing aperture in said wall communicating with each of said discrete spaces.

9. The nursing container of claim 7 wherein said segmenting means includes at least two radially extending walls disposed between said elongated member and said outer wall.

10. The nursing container of claim 1 further comprising a rigid cylindrical support enclosing the fluid bag and attached at one end to the mounting means.

11. The nursing container of claim 10 wherein the rigid support is inserted into the mounting means radially outside of the bag.

12. The nursing container of claim 1 wherein the mounting means has a tapered annular shoulder facing opposite the resiliently deformable wall and said fluid container is sealed to the mounting means at said shoulder.

13. The nursing container of claim 1 wherein the nipple includes two distinct gripping areas.

14. An artificial nipple for a nursing container for a suckling infant comprising;

an elongated flexible nipple portion including a generally cylindrically-shaped hollow deformable outer wall having a substantially closed end including a plurality of dispensing apertures situated generally symmetrically about the closed end; and a resilient elongated member disposed interior of the deformable wall and depending from the closed end, the elongated member and deformable wall cooperating to provide means for allowing the infant to restrict flow through select dispensing apertures.

15. The nipple of claim 14 wherein the nipple includes two distinct gripping areas.

16. The nipple of claim 14 wherein the elongated member is substantially hollow.

17. The artificial nipple of claim 14 wherein said outer wall comprises at least one radially extending annular undulation.

18. The artificial nipple of claim 14 wherein the annular space between said wall and said elongated member is widest interior of said annular undulation.

19. The artificial nipple of claim 14 wherein the wall further comprises a gripping area defined by an annular trough between the closed end and said annular undulation.

20. The artificial nipple of claim 14 wherein the elongated member is thicker at the end distal from the closed end, whereby the annular space between said wall and said elongated member is thinnest adjacent the distal end of said elongated member.

21. The artificial nipple of claim 14 wherein there are at least six but no more than thirty-six dispensing apertures.

22. The artificial nipple of claim 14 further comprising means segmenting said annular space between said wall and said elongated member into a plurality of angularly discrete spaces.

23. The artificial nipple of claim 22 further comprising means defining at least one dispensing aperture in said outer wall communicating with each of said discrete spaces.

* * * * *